United States Patent [19]

Greene

[11] Patent Number: 4,904,398

[45] **Date of Patent: * Feb. 27, 1990**

[54] CLASS D FIRE EXTINGUISHING

[75] Inventor: Jay S. Greene, Manheim, Pa.

[73] Assignee: Environmental Security Incorporated, Gloucester, Mass.

[ * ] Notice: The portion of the term of this patent subsequent to Jan. 30, 2007 has been disclaimed.

[21] Appl. No.: 167,719

[22] Filed: Mar. 14, 1988

Related U.S. Application Data

[63] Continuation-in-part of Ser. No. 904,279, Sep. 8, 1986, and Ser. No. 695,349, Jan. 25, 1985, and Ser. No. 744,771, Jun. 14, 1985, abandoned.

[51] Int. Cl.[4] ..... A62D 1/00; A62C 1/00; A62C 3/00

[52] U.S. Cl. ..... 252/2; 252/4; 252/6; 252/7; 252/355; 169/46; 169/47

[58] Field of Search ..... 252/2, 7, 8, 8.05, 198, 252/355, DIG. 1; 169/46, 47; 210/749; 239/461

[56] References Cited

U.S. PATENT DOCUMENTS

| | | | |
|---|---|---|---|
| 3,531,407 | 9/1970 | Philips et al. | 252/2 |
| 3,565,801 | 2/1971 | Birchall et al. | 252/8.05 |
| 3,637,022 | 1/1972 | Kelly et al. | 252/8.05 |
| 4,248,733 | 2/1981 | States, Sr. | 252/355 |
| 4,636,325 | 1/1987 | Greene | 252/75 |
| 4,725,370 | 2/1988 | Greene | 252/8.05 |

FOREIGN PATENT DOCUMENTS 1516977 7/1978 United Kingdom .

OTHER PUBLICATIONS

Hawley G. 1981, The Condensed Chemical Dictionary–10th edition, Van Nostrand Reinhold, Co., New York, pp. 32–33.

*Primary Examiner*—Howard J. Locker
*Attorney, Agent, or Firm*—Nixon & Vanderhye

[57] ABSTRACT

A Class D (combustible metals) firefighting agent comprises a detergent mixture, and sodium chloride (about 4.5–12%), although vitamin B-6 and bicarbonate soda may be present. The detergent mixture comprises an alkylbenzolyate sulfonate, non-ionic detergent and lauric superamide, preferably comprising, by volume: about 26–33% linear alkylbenzene sulfonate, about 4.5–6% isoctylphenyl polyethoxyethanol, about 0.25–3% polyoxyethylene sorbitan monooleate, about 4.5–6% lauric diethanolamide, about 0.25–2% monoethanolamide superamides, and water. Burning titanium, uranium, magnesium, zerconium, or any other type of combustible metal fire, can be extinguished by applying the liquid formulation directly to the fire using conventional firefighting equipment.

9 Claims, No Drawings

CLASS D FIRE EXTINGUISHING

RELATED APPLICATIONS

This application is a continuation-in-part of application Ser. Nos. 904,279 filed Sept. 8, 1986, 695,349 filed Jan. 25, 1985, and 744,771 filed June 14, 1985 (abandoned).

BACKGROUND AND SUMMARY OF THE INVENTION

Extinguishing Class D fires, that is combustible metal fires, is exceptionally difficult. There were no known liquid firefighting agents prior to the invention in the parent applications which were capable of extinguishing Class D fires. While the compositions shown in the parent applications worked very well in extinguishing Class D fires, under some circumstances they are as easy to apply with conventional firefighting equipment (e.g. nozzles and the like) as is desired. However according to the present invention, a liquid formulation for Class D firefighting is provided which is essentially as effective as the compositions in the parent applications, yet can be readily applied with conventional firefighting equipment. The liquid formulation according to the invention includes a linear alkylbenzene sulfonate, non-ionic detergent and lauric superamide detergent mixture comprising the majority of the total mass of the formulation. Sodium chloride is provided in an amount of about 4.5–41%, preferably about 4.5–12%. While vitamin B-6 and bicarbonate of soda can be provided in the amount up to about 3 and 18% respectively, preferably no vitamin B-6 or bicarbonate of soda is provided. 0 to 4% by weight of the detergent mixture may be coloring and perfuming agents, and a volume of water is provided only large enough to provide effective mixing of the other components of the formulation, but insufficiently large to interfere with the use of the formulation as an effective Class D firefighting agent. The detergent mixture component of the formulation preferably comprises, by volume: about 26–33% linear alkylbenzene sulfonate, about 4.5–6% isooctylphenyl polyethoxyethanol, about 0.25–3% polyoxyethylene sorbitan monooleate, about 4.5–6% lauric diethanolamide, about 0.25–2% monoethanolamide superamides, and water.

The invention also contemplates a method of formulating a Class D liquid firefighting agent, and a method of extinguishing a combustible metal fire applying the liquid firefighting agent described above with conventional firefighting liquid application apparatus.

It is the primary object of the present invention to provide an effective Class D firefighting liquid composition, and method of formulation and fire extinguishment utilizing the same, that is readily applied by conventional firefighting equipment. This and other objects of the invention will become clear from the detailed description, and the appended claims.

DETAILED DESCRIPTION OF THE DRAWINGS

The basic ingredient of the liquid firefighting formulation according to the invention is a detergent mixture comprising a linear alkylbenzene sulfonate, non-ionic detergent and lauric superamide detergent mixture. That mixture comprises the majority of the formulation, and in the preferred embodiment that mixture comprises about 95% of the total mass of the formulation. It has been found particularly effective if the detergent comprises, by volume: about 26–33% linear alkylbenzene sulfonate, about 4.5–6% isooctylphenyl polyethoxyethanol, about 0.25–3% polyoxyethylene sorbitan monooleate, about 4.5–6% lauric diethanolamide, about 0.25–1% monoethanolamide superamides, and the rest water.

The liquid composition according to the invention also preferably comprises sodium chloride as a significant component thereof. Sodium chloride typically comprises about 4.5–41% by weight of the detergent mixture, with about 4.5–12% being optimum. Sodium chloride densifies the detergent mixture, and prevents it from separating and detonating in Class D fires. It partially dissolves in the detergent mixture down to the molecular level, and will not itself cause detonation. Other commonly-recognized Class D agents are not effective, nor are other salts such as potassium chloride (e.g. potassium will burn when exposed to a burning combustible metal). Preferably essentially no vitamin B-6 or bicarbonate of soda are provided.

The liquid composition according to the invention has a viscosity of only about 16,000 centipoise at about 40° F. This compares to a viscosity of about 68,000 centipoise at 40° F. for some of the compositions in the parent applications.

The liquid composition according to the invention also requires the use of some water in order to provide effective mixing of the other constituents. However, the amount of water is minimized since water will cause the agent to be less effective and may cause separation or detonation. Only enough water is added to the components, besides the detergent mixture, so that they can be mixed properly prior to addition to the detergent mixture during production of the liquid formulation.

Non-toxic and low flammability, coloring and perfuming agents may be added so that the liquid formulation does not have an objectionable appearance or odor. The most suitable coloring material is standard vegetable color, and the best known perfuming agent is eucalyptus oil. These materials are typically added so that their combined total contribution to the liquid formulation is less than about 4% by weight of the detergent mixture.

In the method of formulating the Class D liquid firefighting agent according to the invention, an effective amount of sodium chloride is added to a minimum amount of water sufficient to facilitate mixing of the components, and mixed with the detergent mixture so as to provide a homogeneous liquid combustible metals firefighting agent.

In extinguishing a combustible metal fire utilizing the agent according to the invention, it is applied at essentially 100% concentration. If water is added, it will decrease effectiveness and may cause separation and detonation. It is applied at a system pressure desirably no less than 50 pounds per square inch, and preferably within the range of about 50–200 pounds per square inch. It is desirably not applied with a straight stream nozzle as the pressure of any stream against the combustible metal tends to cause hot metal fragments to be dispersed in all directions. It is best applied with a wide angle fog nozzle, or existing sprinkler systems which have heads which will break up the liquid stream into a dispersed pattern.

The Class D firefighting agent according to the invention is capable of fighting all combustible metal fires.

For example it can extinguish titanium, magnesium, zerconium, zercalloy (a zerconium alloy with a very low ignition temperature), graphite, and uranium fires. Even if the metals are radioactive (such as uranium, plutonium, or graphite which has become radioactive due to close contact over a long period of time with uranium, plutonium, or the like), the agent is effective to extinguish the fire within a short period of time.

EXAMPLES

A Class D firefighting liquid composition was formulated by mixing a detergent mixture (of the components and percentages described above) with 4.5–12% by weight sodium chloride, and a minimum amount of water, only enough to provide effective mixing of the components, and about 0.5% by weight vegetable color. This product was suitable for direct application to Class D fires by spraying in on the fires with a fog nozzle, or the like, of conventional firefighting equipment. Utilizing this liquid composition as a firefighting agent, the following tests were conducted:

| Test | #A | #B |
|---|---|---|
| Type of Metal Tested | Magnesium | Magnesium Block, Aircraft Engine Cowling Pieces of Fuselage |
| Condition of Metal | Chips (spounge)* | Solid Engine Block, and Sheet Metal** |
| Size of Fire | 2 Sq. Ft. × 4" High | 16 Sq. Ft., 4 Ft. High |
| Amount of Metal Tested | 4 Lbs. | 175 Lbs. |
| Equipment Used | 15 Gal. Extinguisher | 15 Gal. Extinguisher |
| Amount of Agent Used | 5 Gal. | 15 Gal. |
| Denstiy-Gal/Lb of Metal | 1.25 | .09 |
| Total Extinguishment Time | .45 Min. | 1.10 Min. |

| Test | #C | #D |
|---|---|---|
| Type of Metal Tested | Zercalloy | Magnesium & Zercalloy |
| Condition of Metal | Turnings | Sponge & Turnings |
| Size of Fire | 16 Sq. Ft. × 24" High | 16 Sq. Ft. × 15" High |
| Amount of Metal Tested | 60 lbs. | 10 & 30 lbs. |
| Equipment Used | 15 Gal. Extinguisher | 15 Gal. Extinguisher |
| Amount of Agent Used | 15 Gal. | 15 Gal. |
| Density-Gal/Lb of Metal | .25 Gal. | .375 Gal. |
| Total Extinguishment | 3.50 Min. | 2.50 Min. |

*The Magnesium Sponge as packaged in a box and allowed to sink into a snow pile after ignition to make extinguishment more difficult.

**The reason for the assorted metals was to test multiple surfaces and positions forcing the operator to move around the fire. The priority was to simultaneously test multiple metals which are common to aircraft and other areas.

In all cases, the agent extinguished the fires effectively. The agent is capable of long term stable storage and portable equipment.

While of course small amounts of contaminants are tolerable, with no adverse affect on the ability of the firefighting agent according to the invention to extinguish combustible metal fires, it is desirable that the agent consist essentially of the detergent mixture and sodium chloride, with a minimal amount of water, and—if desired—small amounts of non-toxic and low flammability perfuming and coloring agents.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent formulations and procedures.

What is claimed is:

1. A liquid formulation for use as a Class D firefighting agent and consisting essentially of a mixture of:

a linear alkylbenzene sulfonate, non-ionic detergent and lauric superamide detergent mixture comprising the majority of the total mass of the formulation;

vitamin B-6 in the amount of 0–3 percent by weight of the detergent mixture;

sodium chloride in the amount of about 4.5–41% percent by weight of the detergent mixture;

bicarbonate of soda in the amount of about 0–18 percent by weight of the detergent mixture;

0–4 percent by weight of the detergent mixture coloring and perfuming agents; and a volume of water large enough only to provide effective mixing of the other components of the formulation and insufficiently large to interfere with the use of the formulation as an effective Class D firefighting agent.

2. A formulation as recited in claim 1 wherein the amount of vitamin B-6 is 0%, the amount of bicarbonate of soda is 0%, and the amount of sodium chloride is about 4.5–12%.

3. A formulation as recited in claim 2 wherein the detergent mixture comprises, by volume: about 26–33% linear alkylbenzene sulfonate, about 4.5–6% isooctylphenyl polyethoxyethanol, about 0.25–3% polyoxyethylene sorbitan monooleate, about 4.5–6% lauric diethanolamide, about 0.25–2% monoethanolamide superamides, and water.

4. A formulation as recited in claim 3 wherein the detergent mixture comprises about 95% by weight of the total mixture.

5. A method of formulating a Class D liquid firefighting agent which includes a detergent mixture comprising an alkylbenzene sulfonate, non-ionic detergent and lauric superamide, comprising the steps of:

adding amounts of materials consisting essentially of sodium chloride, and small amounts of coloring and perfuming agents if desired, effective when, in formulation, to put out a Class D fire, to a minimum amount of water sufficient to facilitate mixing of the components; and mixing the sodium chloride and water together with the detergent mixture so as to provide a homogeneous Class D firefighting agent.

6. A method of extinguishing a combustible metal fire comprising the steps of:

applying directly to the fire, with conventional firefighting liquid application apparatus, a liquid composition consisting essentially of a major part of detergent mixture of linear alkylbenzene sulfonate, non-ionic detergent and lauric superamide, and amounts of vitamin B-6, sodium chloride, and/or bicarbonate of sodium, with minimal amounts of water, and with small amounts of coloring and perfuming agents, if desired, effective when, in formulation, to put out a combustible metal fire, by slowing down the detergent mixture emulsification rate; densifying and increasing the heat absorption capability of the detergent mixture; agitating and stabilizing the detergent mixture; and densifying and preventing separation and detonation of the detergent mixture when exposed to burning metal.

7. A method as recited in claim 5 wherein the components of the liquid composition besides the detergent mixture consist essentially of: vitamin B-6 in an amount of about 0–3% by weight of the detergent mixture; sodium chloride in an amount of about 4.5–41% by weight of the detergent mixture; and bicarbonate of soda in an amount of about 0–18% by weight of the detergent mixture; with small amounts of non-toxic, relatively low flammability, coloring and perfuming agents as desired.

8. A method as recited in claim 6 wherein the components of the liquid composition comprise 0% vitamin B-6, 0% bicarbonate of soda, and about 4.5–12% NaCl.

9. A method as recited in claim 8 wherein the detergent mixture component of the formulation comprises by volume: about 26–33% linear alkylbenzene sulfonate, about 4.5–6% isooctylphenyl polyethoxyethanol, about 0.25–3% polyoxyethylene sorbitan monooleate, about 4.5–6% lauric diethanolamide, about 0.25–2% monoethanolamide superamides, and water.

* * * * *